US005319863A

United States Patent [19]

Kotitschke et al.

[11] Patent Number: 5,319,863

[45] Date of Patent: * Jun. 14, 1994

[54] DRYER SECTION

[75] Inventors: Gerhard Kotitschke, Steinheim; Georg Kugler; Wolfgang Mayer, both of Heidenheim, all of Fed. Rep. of Germany

[73] Assignee: J. M. Voith GmbH, Fed. Rep. of Germany

[ * ] Notice: The portion of the term of this patent subsequent to Feb. 9, 2010 has been disclaimed.

[21] Appl. No.: 126,785

[22] Filed: Sep. 24, 1993

Related U.S. Application Data

[60] Division of Ser. No. 10,419, Jan. 28, 1993, Pat. No. 5,529,534, which is a continuation-in-part of Ser. No. 467,788, Jan. 19, 1990, Pat. No. 5,184,408.

[51] Int. Cl.[5] ..... F26B 5/04

[52] U.S. Cl. ..... 34/414; 34/117; 34/120; 34/115; 34/459

[58] Field of Search ..... 34/114, 113, 115, 116, 34/117, 120, 123, 16, 23

[56] References Cited

U.S. PATENT DOCUMENTS

| | | | |
|---|---|---|---|
| 2,537,129 | 1/1951 | Goodwillie | 92/49 |
| 2,696,149 | 12/1954 | Hornbostel | 92/49 |
| 2,892,263 | 6/1959 | Hornbostel | 34/120 |
| 2,959,222 | 6/1957 | Hornbostel | 162/360 |
| 3,868,780 | 3/1975 | Soininen et al. | 34/116 |
| 4,359,827 | 11/1982 | Thomas | 34/16 |
| 4,625,430 | 12/1986 | Aula et al. | 34/13 |
| 4,905,379 | 3/1990 | Wedel | 34/16 |
| 4,934,067 | 6/1990 | Wedel | 34/41 |
| 4,972,608 | 11/1990 | Iivespaa | 34/115 |
| 5,184,408 | 2/1993 | Kotitschke et al. | 34/117 |

*Primary Examiner*—Denise Gromada

*Attorney, Agent, or Firm*—Ostrolenk, Faber, Gerb & Soffen

[57] ABSTRACT

A dryer section of a machine for manufacturing fiber webs, which includes a plurality of heatable drying cylinders arranged to form at least a first dryer group and a second dryer group, and arranged in horizontal cylinder rows, and including a plurality of suction rolls each being disposed between two adjacent cylinders. The cylinders of the first group have axes disposed in a first plane I, the suction rolls of the first group have axes disposed in a second plane II, the cylinders of the second group have axes disposed in a third plane III, and the suction rolls of the second group have axes disposed in a fourth plane IV. In accordance with different embodiments planes I and II may be coplanar, planes II and III may be coplanar; planes I and III may be disposed between planes II and IV; and the axes of the first drying cylinders and its associated suction roll of the second group may be disposed below the axes of the other drying cylinders and suction rolls of the second group.

15 Claims, 6 Drawing Sheets

DRYER SECTION

This application is a division of application Ser. No. 08/010,419, filed Jan. 28, 1993, now U.S. Pat. No. 5,295,311 which is a continuation-in-part of U.S. Ser. No. 07/467,788 filed Jan. 19, 1990 and entitled Dryer Section now U.S. Pat. No. 5,184,408.

BACKGROUND OF THE INVENTION

In FIG. 3 of U.S. Pat. No. 4,986,009, a dryer section is disclosed. The purpose of such a dryer section is to dry a fiber web, in particular within a paper-making machine having a verv high operating speed. The maximum operating speed may be about 1,500 m/min or even higher.

Critical points of such a dryer section are:

1. The area where the fiber web is transferred from one dryer group to the next dryer group.
2. The so-called departure points where the fiber web and the support belt depart from the drying cylinders.

In the above-mentioned FIG. 3, for transferring the web from a first to a second dryer group, a first suction roll of the second dryer group has the function of a pick-up roll (75). The support belt (70) of the first dryer group travels around a last suction roll (74) and then tangentially to the periphery of the pick-up roll (75) around which the support belt of the second dryer group travels. Upstream of pick-up roll (75), the two support belts (70 and 80) are forming a so-called convergence angle which may be, e.g. between 3° and 30°.

This configuration disclosed in FIG. 3 is preferred to that of FIG. 1 of the above-mentioned U.S. patent. In FIG. 1, the pick-up roll is designated (24*a*) upstream of which the two support belts are traveling parallel (from roll 24 to the roll 24*a*). In this configuration the fiber web may be subjected to stress, if the two support belts must travel at a certain differential speed.

The high operating speed mentioned above is obtainable, among others, due to the suction rolls since the fiber web is held by suction against the support belt when it travels over the suction rolls, against the centrifugal force exerted on the fiber web. In the area, where the fiber web and the support belt are traveling from the periphery of the so-called delivering drying cylinder onto the periphery of the following suction roll, the fiber web should also be safely held against the support belt. To accomplish this goal, it is known from international publication WO 83/00514, FIG. 2, to provide a very short distance between the periphery of the suction roll and the peripheries of the adjacent drying cylinders. However, a problem may arise from the fact that the suction roll is positioned symmetrically with respect to the two adjacent drying cylinders: in some cases, an air blow box may be arranged on the periphery of the suction roll, preferably covering only the second half of the zone looped by the support belt (as disclosed in FIG. 3 of the above-mentioned U.S. patent). This may result in an unfavorable small distance between the air blow box and the periphery of the adjacent drying cylinder.

It is a general object of the invention to improve the runability of the dryer section (allowing an extremely high operating speed and avoiding web breaks) while maintaining a high drying efficiency.

It is a further object of the invention to improve the function of the pick-up roll such that the fiber web is safely transferred from one dryer group to the next, permitting a very high operating speed and avoiding any stress subjected to the fiber web. To accomplish this, according to a first aspect of the invention, the second support belt comes into contact with the first support belt only within a small portion of the periphery of the pick-up roll. In other words, a small portion of the periphery of the pick-up roll is wrapped by the support belt of the first dryer group. Preferably, the angle of this periphery portion is selectable during operating of the machine.

It is a further object of the invention to provide an open web draw or open transfer between adjacent dryer groups in order to allow a small web speed differential between the two groups. This results from a further aspect of the invention wherein the support belt is adjustable so that it is out of contact with the periphery of the pickup roll.

It is a further object of the invention to provide a configuration which guarantees holding the fiber web against the support belt when it travels from one of the drying cylinders to the following suction roll while an air blow box may be arranged on the periphery of the suction roll, preferably in the second half of the zone wrapped by the support belt and/or while a certain space should be maintained where vapor escapes from the web before the web comes into contact with the next cylinder.

DETAILED DESCRIPTION

Figure 1:
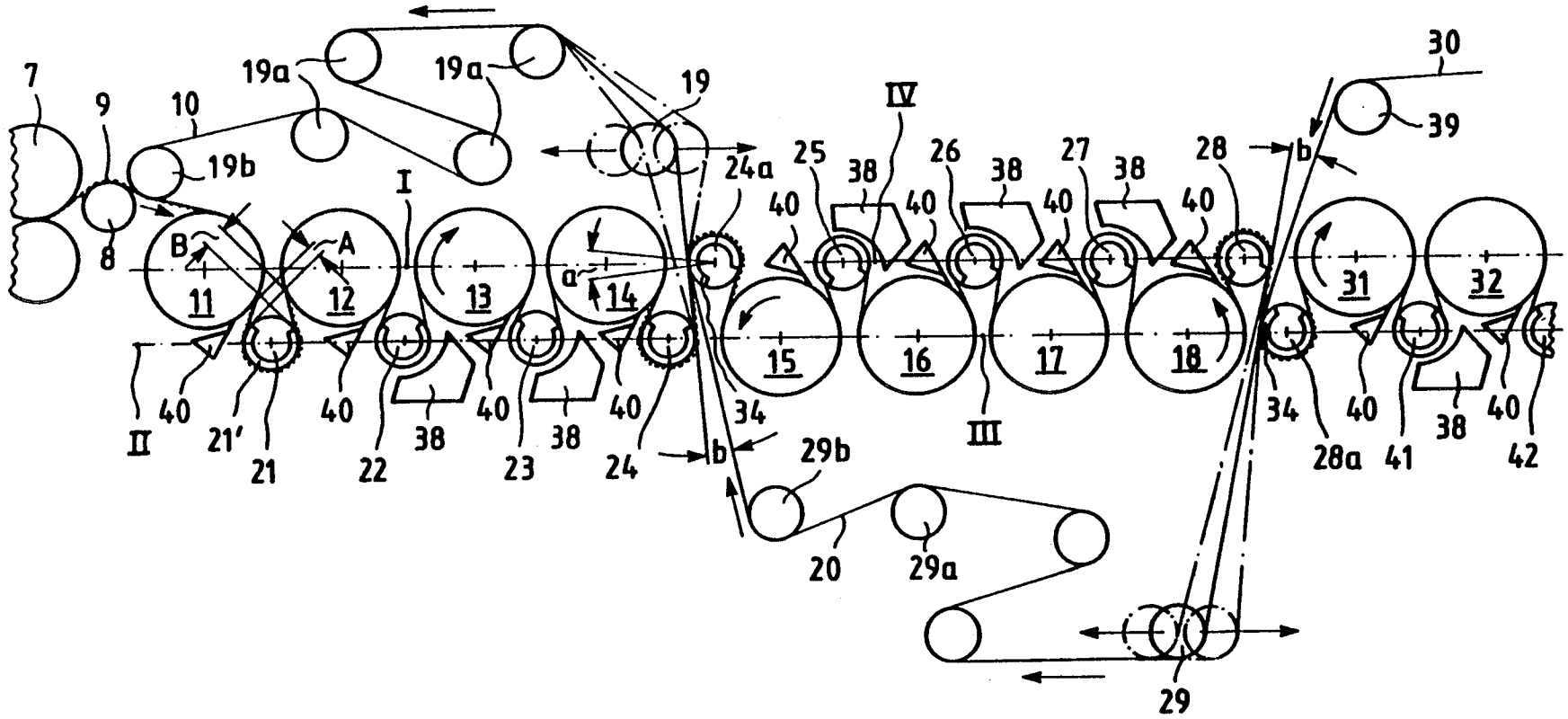
FIG. 1 is a schematic side elevation of a drying apparatus or "dryer section" of which three drying groups are shown.

Anyone of the various drying apparatus illustrated may be selected as part of a paper making machine. The paper web 9 to be dried (partly shown in a dotted line), in the illustrated embodiment, runs through the drying apparatus from left to right. A first drying group comprises four upper, heatable drying cylinders 11 through 14 and four lower felt rolls designed as suction rolls 21 through 24.

A paper support roll 8 transfers the paper web 9 from a press section 7 to a first endless backing belt 10 or "support belt", which preferably is fashioned as a porous wire belt ("dryer fabric") and which travels over a first belt roll 19*b*; this may be a suction roll if required. Together with the backing belt 10, the paper web 9 meanders through the drying group, i.e., alternately over the drying cylinders 11 through 14 and over the suction rolls 21 through 24. From the last suction roll 24, the backing belt 10 runs over several normal belt rolls 19 and 19*a* back to the first belt roll 19*b*. At the departure point from each drying cylinder 11–14, there is a very short distance A (about 30 to 100 mm) between the peripheries of the cylinder and the adjacent suction guide roll. This prevents the web 9 from sticking at the cylinder surface; the web rather follows the support belt 10, under the influence of the suction gland (e.g. 21') of the suction roll. The latter may have a conventional stationary inner suction box or an outer suction box as disclosed in U.S. Pat. No. 4,202,113. Web stabilizers as shown in U.S. Pat. No. 4,986,009 are no more necessary.

The second drying group comprises four lower heatable drying cylinders 15 through 18 and five upper suction rolls 24a and 25 through 28. Passing through this drying group is a second backing belt 20, which from the last suction roll 28 runs over several belt rolls 29, 29a and 29b back to the first suction roll 24a. This latter suction roll 24a (or "pick-up roll") picks the paper web up from the backing belt 10, and when the web is in contact with the suction roll 24a, this transfer to the roll 24a avoids an open web draw. At the end of this second drying group, i.e., downstream of the last suction roll 28, the paper web 9 is transferred by a further pick-up roll 28a to the next drying group; again an open web draw can be avoided. Visible of that third group are only two drying cylinders 31 and 32, a backing belt 30, suction rolls 41, 42 and a belt roll 39. In the first dryer group, the underside or "first side" of web 9 contacts the drying cylinders 11–14. In the second dryer group, the upperside or "second side" of web 9 contacts the drying cylinders 15–18. In the third dryer group, the first web side again contacts the cylinders 31, 32.

The belt roll 19 (following to the last suction roll 24 of the first dryer group) is shiftable approximately horizontally. The roll 19 is shown in three different positions: In full lines, it is in one normal position wherein the draw of belt 10 from roll 24 to roll 19 is straight and tangent to the periphery of pick-up roll 24a. In this position, the second belt 20 comes into contact with the first belt 10 approximately only at a "point" as seen in the drawing. A second possible position of the belt roll 19 is shown in dot-dash-lines, wherein the second belt 20 comes into contact with the first belt 10 over a small portion of the periphery of pick-up roll 24a, said portion comprising an angle a of about 10°. This angle a may be varied between zero and at most 20° by shifting of belt roll 19. Thus, the operator is able to select any size of angle a according to the actual requirements, with the, angle a depending upon the type of web to be dried or upon the operating speed or upon the amount of a speed difference sometimes needed between the two belts 10 and 20. The third position of the roll 19 is shown in dash-two-dot lines. Here the web is separated off the pickup roll 24a, and this is an open draw or open transfer condition. In all three positions of the roll 19 the transfer of web 9 from the first to the second dryer group can be achieved safely even with the highest operating speeds, without the risk of web breaks. Furthermore, the threading of the so-called transfer strip (a narrow edge strip of the web) into the dryer section (e.g. after a shut down) may be accomplished automatically without the assistance of a so-called rope carrier system.

It should be noted that—irrespective of the size of angle a—the two belts 10 and 20, where travelling towards pick-up roll 24a are forming a wedge-like gap including a so-called convergence angle b. The size of this angle may be freely selected between about 3° and 30°, according to space conditions.

If the second support belt 20, travelling from belt roll 29b to pick-up roll 24a, transports air boundary layers which tend to impair the web transfer it is helpful to provide a prolonged suction gland 34 or a separate pre-suction zone in pick-up roll 24a at the side where belt 20 is running towards pick-up roll 24a. The presuction zone draws off the boundary layer of air traveling on the side of the web facing toward the roll 24a, enabling the remaining portion of the suction zone to draw the web to the pickup roll 24a.

For some reasons (e.g. one of the dryer groups must be shut down while the others are running or the belts run with an open draw transfer it may be helpful to provide temporarily a distance between the two belts 10, 20 at pick-up roll 24a. In this case, roll 19 may be shifted into the position shown with twin-dot-dash lines which affords a gap between the belt 10 and the pickup roll 24a as the dryer groups both operate.

As conventional, a doctor 40 is installed at the free surface of each drying cylinder. Furthermore, at some of the suction rolls 22–27 and 41, an air blow box 38 may be provided which may include a suction chamber (not shown) for the removal of moist air. Each of the blow boxes 38 envelopes the pertaining suction roll over approximately one-fourth of its periphery, namely in the second half of the zone looped by the support belt 10 or 20 or 30. For this reason, in the first and in the second dryer group, each of the suction rolls 21–27 is positioned asymmetrically with respect to the two associated drying cylinders, those three rolls forming a set comprising a "web delivery cylinder" (e.g. 12), the suction roll 22 and a "web receiving cylinder" 13. Now, while maintaining the very small distance A, mentioned above, between the peripheries of the web delivering cylinder and the suction roll, there is a larger distance B (about 2 to 10 times larger) between the peripheries of the suction roll and the web receiving cylinder. In this way, space is obtained for said doctor 40, the air blow box 38 and a relatively large gap needed therebetween as well as a gap needed between the air blow box and the web receiving cylinder, space is maintained where vapor escapes from the web, irrespective whether a blow box is present or not.

After the web has received a certain dryness, e.g. at the end of the second dryer group, the tendency that the web sticks to the cylinder surface may be less than before. Therefore, e.g. being in the third dryer group, the distance between the web delivering side of each cylinder and the following suction roll may be larger than before. In other words: It may be possible then, to arrange each such roll symmetrically with respect to the two associated cylinders as shown at 31, 32 and 41.

In the embodiment shown in FIG. 1, all drying cylinders are arranged in horizontal cylinder rows. However, the principles of the invention may also be employed in a dryer section having vertical cylinder rows, as disclosed in U.S. Pat. No. 5,050,317.

Additionally, in the embodiment of FIG. 1, it should be noted that the cylinders of the first dryer group have axes disposed in a first plane I, the suction rolls of the first group have axes disposed in a second plane II, the drying cylinders of the second group have axes disposed in a third plane III, and the suction rolls of the second group have axes disposed in a fourth plane IV. Also, as seen in FIG. 1, planes I and IV are coplanar and planes II and III are coplanar.

Figure 2:
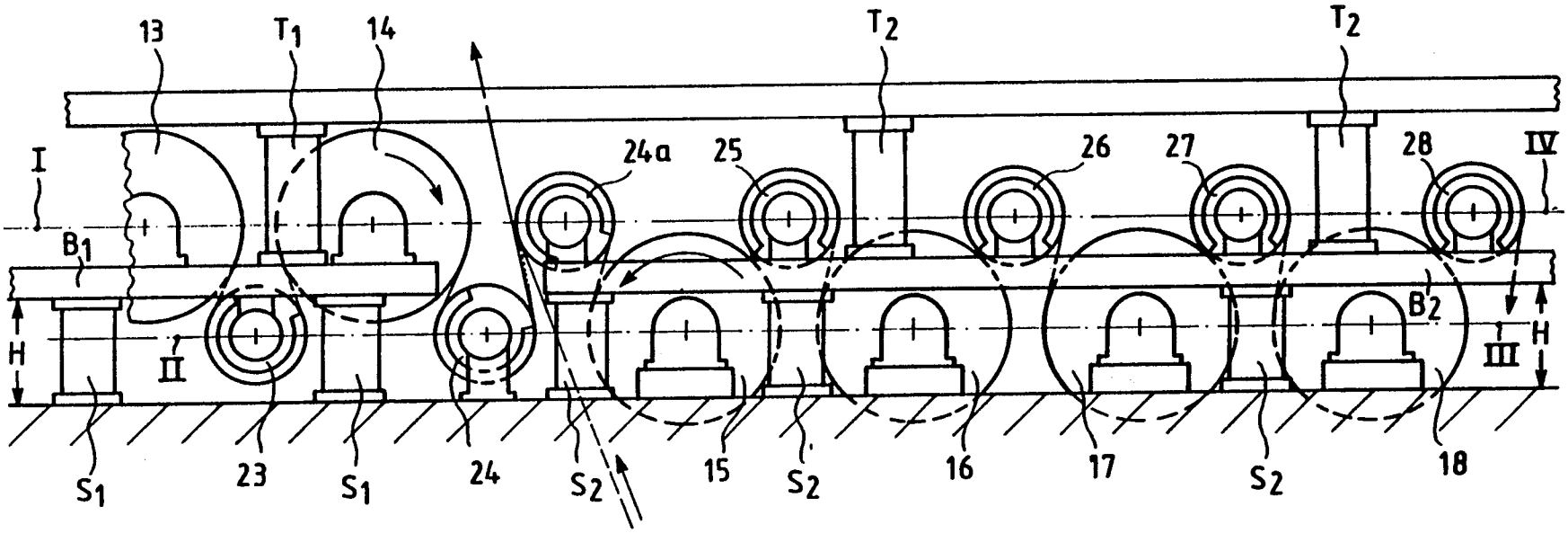
FIG. 2 is a side elevation of the dryer section of FIG. 1 showing supporting structure for the drying cylinders and suction rolls.

Referring to FIG. 2, the advantage of such an arrangement is that in both the first and second dryer groups the lower longitudinal support beams B1 and B2 are at the same height H. Accordingly, all of the lower support stands S1 and S2 are of equal heights and all of the upper stands T1 and T2 are of equal heights. Furthermore, in FIG. 2, as in the double dot-dash arrangement of roll 19 and belts 10 and 20 in FIG. 1, the support belt of the first group is spaced away from the pickup roll 24*a* and the web transfers across the resulting gap in an open draw or open transfer.

Figure 3:
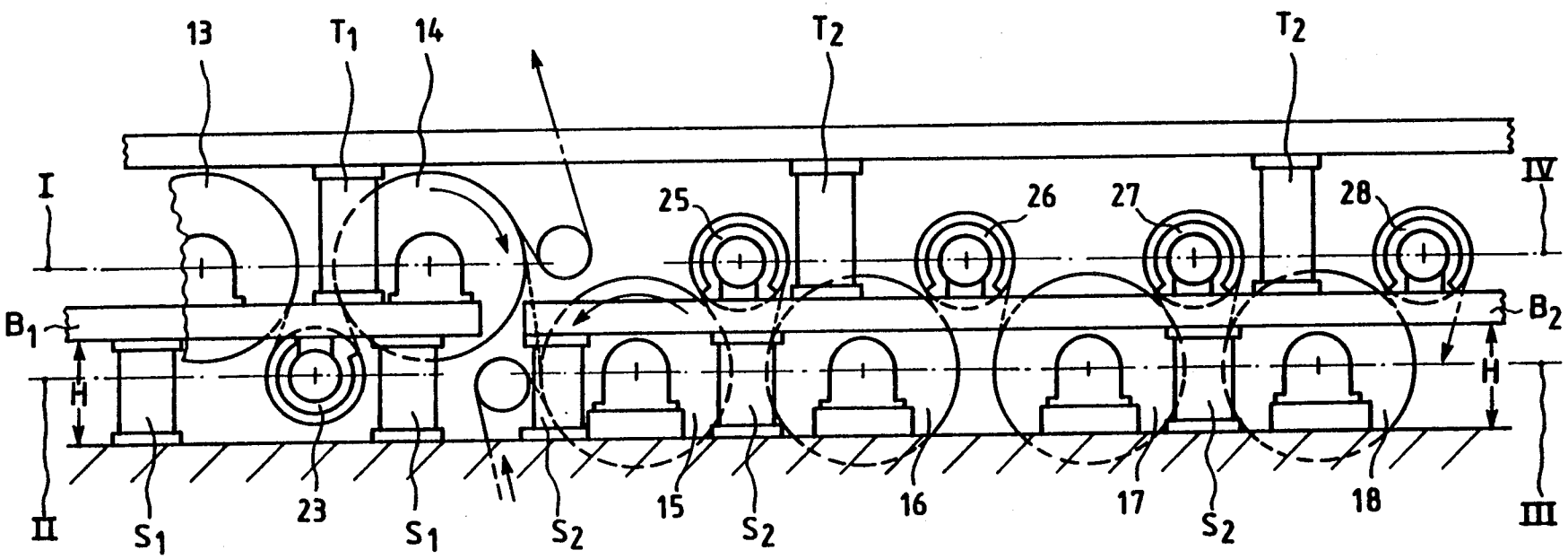
FIGS. 3 & 4 are side elevations view of an alternative embodiment of a dryer section in accordance with the present invention with an open draw between dryer groups rather than use of suction rolls.

Referring to FIG. 3, there is shown a dryer section similar to the dryer section in FIG. 2 except in the dryer section of FIG. 3 the transfer between the first and second dryer groups is by means of a larger open draw, wherein the suction rolls 24 and 24*a* of FIGS. 1 and 2 are eliminated and replaced with felt rolls 2 and 3. As will be noted, like the embodiment of FIGS. 1 and 2, in the embodiment of FIG. 3, the planes I and IV are coplanar and the planes II and III are coplanar.

Figure 4:
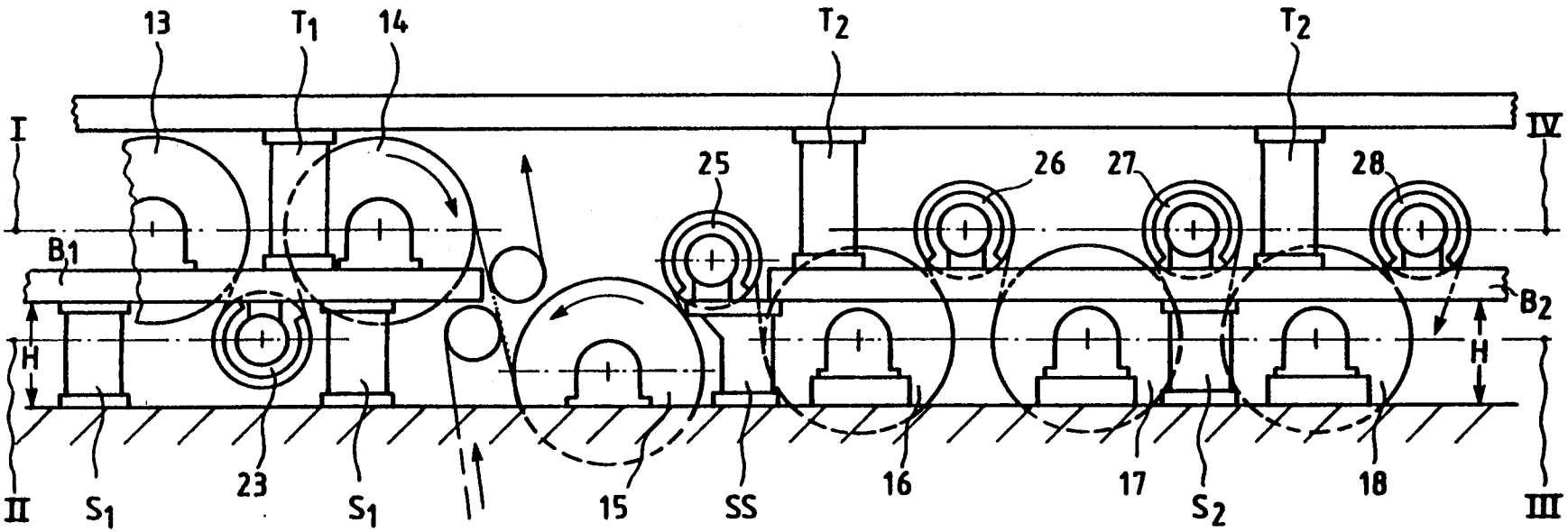
Figure 5:
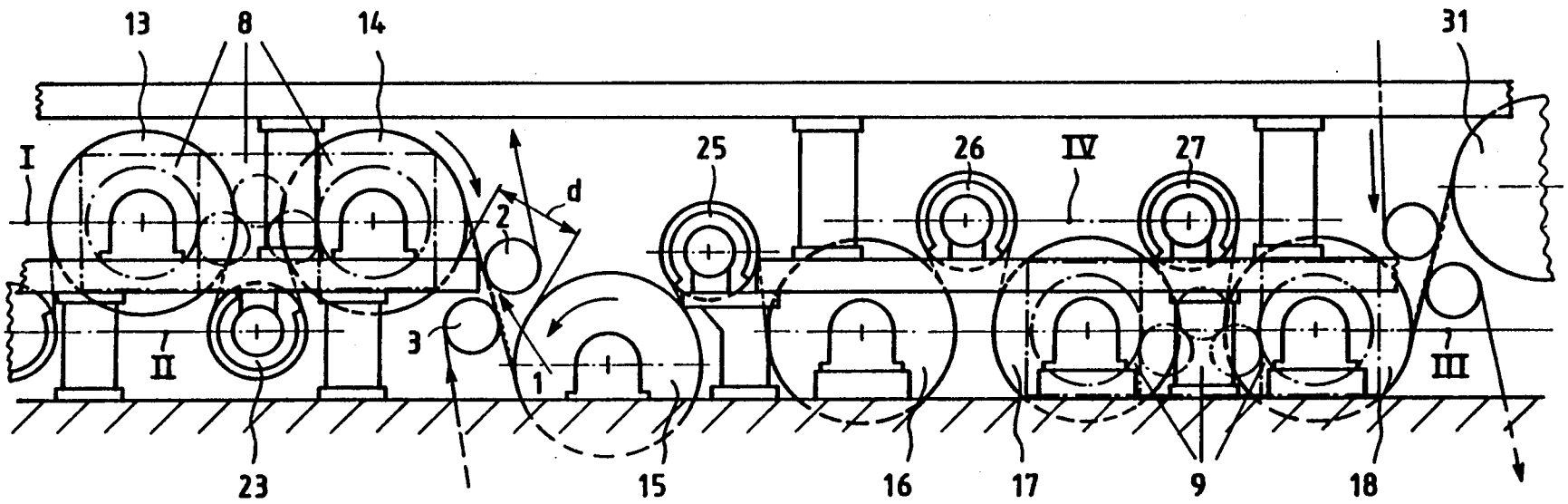
FIG. 5 is a side elevation view of the embodiment of FIG. 4 showing gear assemblies for driving the dryer groups.

Turning now to FIG. 4, this is essentially the same as the embodiment of FIG. 3 except that the first drying cylinder 15 of the second group and its associated suction roll 25 are shifted downward from the other drying cylinders 16, 17 and 18, and other suction rolls 26, 27 in the second group for reasons which will become apparent from the discussion of FIG. 5. Before proceeding to that discussion, it should be noted that the embodiment of FIG. 4, like the embodiment of FIG. 3, enables the longitudinal beams B1 and B2 to be at the same height and all of the upper stands T1 and T2 to be of equal height. Similarly, all of the lower stands S1 and S2 may be at the same height and of identical shape, with the exception of the first stand SS which must be of a special shape because it must directly support the suction roll 25 as well as the beam B2.

Turning now to FIG. 5, in which the gear assemblies 8, 9 which drive the dryer groups are shown in dot-dash-lines, it will be seen that two felt rolls 2 and 3 are between the last dryer cylinder 14 of the first dryer group and the first dryer cylinder 15 of the second dryer group are arranged relatively close to one another in order to provide a short open web draw. As a result the distance d between dryers cylinders 14 and 15 is larger than the corresponding distance in FIG. 3. This greater distance is effected, as shown in FIGS. 4 and 5, by offsetting the axis of the first dryer cylinder 15 of the second group downwardly. Theoretically, it would be possible to shift the last dryer in the preceding group (e.g., the dryer 14) upwardly for the same purpose. However, from a practical standpoint, this is not possible because each of the gear assemblies 8, 9 is adapted to drive one of the dryer groups and in each dryer group only some downstream dryers are interconnected by gears (driven by a motor not shown) while the upstream dryers are driven from the downstream dryers by means of their respective endless support belts. Thus, the gear assemblies 8, 9 must be arranged such that the downstream dryer cylinders pull the upstream dryer cylinders. The opposite arrangement is not acceptable. For economic reasons, each gear assembly 8, 9 comprises the same gear elements and all elements of each gear assembly are arranged on the same level. Therefore, the axes of all dryer cylinders which are coupled to one of the gear assemblies have to be arranged on the same level or plane. Thus, the last cylinder in the drying groups, since it is a downstream cylinder, cannot be displaced from the axes of the other dryer cylinders in the group. But, since the first dryer cylinder in each group is not coupled to the gear assembly, it may be displaced from the other dryer cylinders in its group, as shown in FIGS. 4 and 5.

Figure 6:
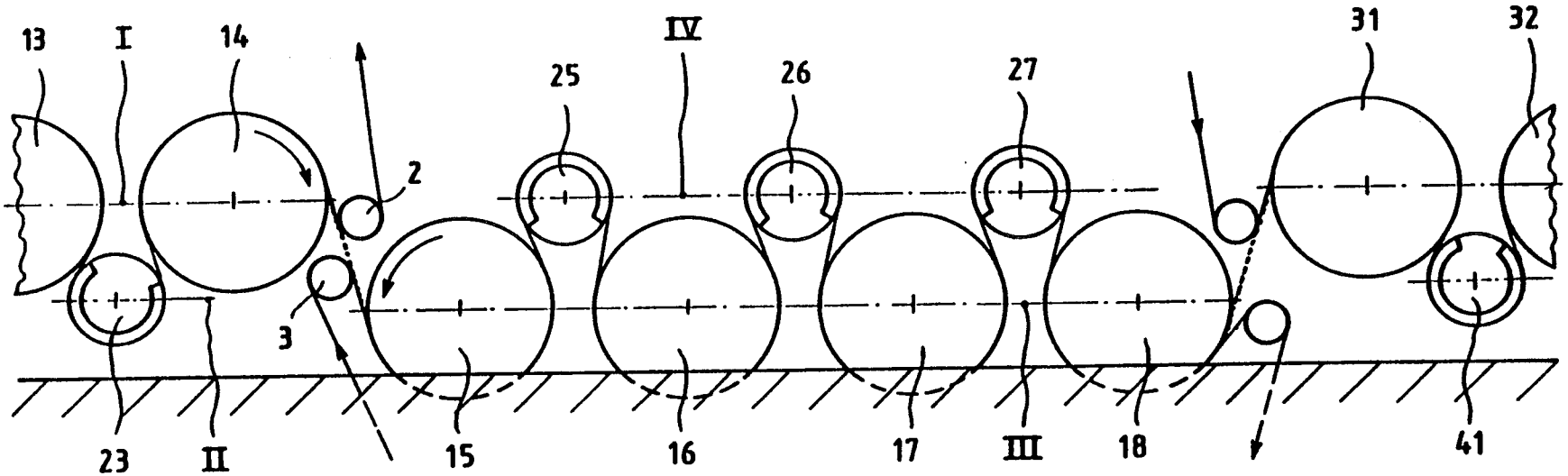
FIG. 6 is a schematic side elevation view of an additional embodiment of the invention employing an open draw between dryer groups.

FIG. 6 shows an alternative embodiment in which while planes I and IV are coplanar, planes II and III are not with plane III being lower than plane II for the following reasons.

The vertical distance between planes I and III may be approximately equal to the vertical distance between the axes of dryers 14 and 15 of FIGS. 4 and 5. Therefore, it is again possible, if required, to arrange felt rolls 2 and 3 relatively close to one another in order to provide a short open web drawer. Nevertheless, in the first group, all dryers 13, 14 are disposed in a single plane I, all suction rolls 23 are disposed in a single plane II, and in the second group all dryers 15–18 are disposed in a single plane III and all suction rolls 25–27 are disposed in a single plane IV. Therefore, no stand must be of a special shape as stand SS in FIGS. 4 and 5.

In the first group, it may be much more important than in the second group to have a very small distance between each web delivery cylinder such as the dryer cylinder 13 and the following suction roll, such as the suction roll 23 (as explained above). The reason for this is that in the second group, the danger that the web sticks at the cylinder surface may be less than in the first group. Furthermore, in the second group, it is more advantageous to have large evaporation zones at each suction roll 25–27. An evaporation zone extends from the web departure point from one cylinder (e.g., 15) to the web receiving point at the next cylinder (e.g., 16).

In an additional alternative (not shown), planes I and III may be disposed between planes II and IV.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dryer section of a machine for manufacturing fiber webs, the dryer section comprising:

a first dryer group comprising a first plurality of heatable first drying cylinders arranged in series along the path of the fiber web through the first dryer group;

a respective first suction roll between each pair of first drying cylinders; and a first endless support belt passing alternately over the first plurality of drying cylinders and then over the adjacent first suction rolls, such that the fiber web comes into direct contact with the first drying cylinders and the first support belt comes into direct contact with the adjacent first suction rolls;

the first support belt being so oriented that in the first dryer group, a first side of the fiber web contacts the first drying cylinders while a second side of the web contacts the first support belt;

a second dryer group comprising a second plurality of heatable second drying cylinders arranged in series along the path of the fiber web through the second dryer group;

a respective second suction roll between each pair of second drying cylinders; and a second endless support belt passing alternately over the second plurality of drying cylinders and then over the adjacent second suction rolls, such that the fiber web comes into direct contact with the second drying cylinders and the second support belt comes into direct contact with the adjacent second suction rolls;

the second support belt being so oriented that in the second dryer group, the second side of the fiber web contacts the second drying cylinders while the first side of the web contacts the second support belt;

the second dryer group having an upstream end with respect to the path of the web through the dryer section so that the web passes from the first dryer group to the upstream end of the second dryer group;

a third suction roll at the upstream end of the second dryer group before a first one of the second drying cylinders in the second dryer group, the third suction roll being positioned to function as a pickup roll for transferring the fiber web from the first dryer group to the second dryer group;

means supporting the first support belt for adjustment between positions where the first support belt is selectively one of further toward and spaced further away from the pickup roll selectively enabling the formation of a gap between the first support belt and the second support belt at the pickup roll.

2. The dryer section of claim 1, wherein the first and the second support belts are supported to extend to converge toward each other to form a wedge-like gap which narrows smaller toward the pickup roll.

3. The dryer section of claim 2, wherein the means supporting the first support belt for adjusting the position of the first support belt with respect to the pickup roll is also for adjusting the angle of convergence between the first and the second support belts.

4. The dryer section of claim 1, wherein the first drying cylinders have axes disposed in a first horizontal plane I, the first suction rolls have axes disposed in a second horizontal plane II, the second dryer cylinders have axes disposed in a third horizontal plane III and the second suction rolls of the second group have axes disposed in a fourth horizontal plane IV.

5. The dryer section of claim 2, wherein the first drying cylinders have axes disposed in a first horizontal plane I, the first suction rolls have axes disposed in a second horizontal plane II, the second dryer cylinders have axes disposed in a third horizontal plane III and the second suction rolls of the second group have axes disposed in a fourth horizontal plane IV.

6. The dryer section of claim 1, wherein the means for supporting the first belt for adjusting the position of the first support belt with respect to the pick-up roll comprises a first movable felt roll associated with the first support belt.

7. The dryer section of claim 6, including a second movable felt roll associated with the second support belt, the second movable felt roll enabling the first and the second support belts to extend to converge toward each other and to be locatable nearest one another adjacent the pick-up roll.

8. The dryer section of claim 1, wherein the first suction rolls, the second suction rolls, and the third suction roll have about the same diametrical size.

9. A method for drying a paper web in a drying section, the method comprising the steps of:

guiding the paper web through a first dryer group including a first plurality of heatable first drying cylinders arranged in series along the path of the fiber web through the first dryer group; a respective first suction roll between each pair of first drying cylinders; and a first endless support belt passing alternately over the first plurality of drying cylinders and then over the adjacent first suction rolls, such that the fiber web comes into direct contact with the first drying cylinders and the first support belt comes into direct contact with the adjacent first suction rolls; the first support belt being so oriented that in the first dryer group, a first side of the fiber web contacts the first drying cylinders while a second side of the web contacts the first support belt;

thereafter guiding the paper web through a second dryer group comprising a second plurality of heatable second drying cylinders arranged in series along the path of the fiber web through the second dryer group; a respective second suction roll between each pair of second drying cylinders; and a second endless support belt passing alternately over the second plurality of drying cylinders and then over the adjacent second suction rolls, such that the fiber web comes into direct contact with the second drying cylinders and the second support belt comes into direct contact with the adjacent second suction rolls; the second support belt being so oriented that in the second dryer group, the second side of the fiber web contacts the second drying cylinders while the first side of the web contacts the second support belt; the second dryer group having an upstream end with respect to the path of the web through the dryer section so that the web passes from the first dryer group to the upstream end of the second dryer group;

guiding the paper web about a third suction roll at the upstream end of the second dryer group before a first one of the second drying cylinders in the second dryer group, the third suction roll functioning as a pickup roll for transferring the paper web from the first dryer group to the second dryer group;

adjusting the relative positions of the first support belt and the second support belt so that the dryer section is operated with the first support belt selectively further toward or spaced further away or in contact with the second support belt at the third suction roll.

10. The method of claim 9, comprising adjusting the dryer section so that the first support belt and the second support belt contact one another substantially at a point.

11. The method of claim 9, comprising adjusting the drying section so that the first support belt and the second support belt contact one another at the pick-up roll over an arc angle in the range of between 0° to 20°.

12. The method of claim 9, comprising adjusting the drying sections so that the first support belt and the second support belt are spaced from one another so that the paper web transfers from the first support belt to the second support belt without open draw.

13. The method of claim 9, further comprising controlling the first support belt and the second support belt to travel toward each other in a manner which forms a wedge-like gap therebetween which defines a converging angle between the first support belt and the second support belt.

14. The method of claim 13, further comprising setting the size of the converging angle to a value between about 3° and 10°.

15. The method of claim 13, further comprising adjusting the size of the converging angle to a value between about 3° and 30°.

* * * * *